US010040666B2

(12) United States Patent
Björni et al.

(10) Patent No.: US 10,040,666 B2
(45) Date of Patent: Aug. 7, 2018

(54) ARRANGEMENT FOR FIXING THE COMPENSATING WEIGHT GUIDE RAILS OF AN ELEVATOR, AND GUIDE RAIL BRACKET USED IN THE ARRANGEMENT

(71) Applicants: Osmo Björni, Hyvinkaa (FI); Timo Hämäläinen, Helsinki (FI); Markku Ruusuvirta, Rajamaki (FI); Mika Alvesalo, Espoo (FI); Jari Pursiainen, Lempaala (FI); Jari Tarvainen, Lempaala (FI); Simo Mäntynen, Hyvinkaa (FI)

(72) Inventors: Osmo Björni, Hyvinkaa (FI); Timo Hämäläinen, Helsinki (FI); Markku Ruusuvirta, Rajamaki (FI); Mika Alvesalo, Espoo (FI); Jari Pursiainen, Lempaala (FI); Jari Tarvainen, Lempaala (FI); Simo Mäntynen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 1056 days.

(21) Appl. No.: 14/334,334

(22) Filed: Jul. 17, 2014

(65) Prior Publication Data

US 2014/0326545 A1 Nov. 6, 2014

Related U.S. Application Data

(63) Continuation of application No. PCT/FI2013/050083, filed on Jan. 25, 2013.

(30) Foreign Application Priority Data

Jan. 27, 2012 (FI) ..... 20125083 U

(51) Int. Cl.
*B66B 7/02* (2006.01)

(52) U.S. Cl.
CPC ..... *B66B 7/023* (2013.01); *B66B 7/024* (2013.01); *B66B 7/026* (2013.01)

(58) Field of Classification Search
CPC ..... B66B 7/021; B66B 7/023; B66B 7/026; B66B 7/027; B66B 7/10; B66B 7/12
See application file for complete search history.

(56) References Cited

U.S. PATENT DOCUMENTS 1,702,783 A 2/1929 Kiesling
2,463,215 A * 3/1949 Strachan ..... B66B 7/02 187/408

(Continued)

FOREIGN PATENT DOCUMENTS

CA 2385569 A1 4/2001
CN 101061055 A 10/2007

(Continued)

OTHER PUBLICATIONS

AIPN, Machine Translation, JP2005-280970 A, Oct. 2, 2017, pp. 1-9.*

(Continued)

*Primary Examiner* — Minh Truong
(74) *Attorney, Agent, or Firm* — Harness, Dickey & Pierce, P.L.C.

(57) ABSTRACT

The object of the invention is an arrangement and a guide rail bracket for fixing the compensating weight guide rails of an elevator.

16 Claims, 6 Drawing Sheets

(56) References Cited

U.S. PATENT DOCUMENTS

| | | | | |
|---|---|---|---|---|
| 3,211,259 | A * | 10/1965 | Tofanelli | B66B 7/022 187/408 |
| 4,073,114 | A * | 2/1978 | Irish | E04B 1/4107 52/223.13 |
| 5,520,264 | A * | 5/1996 | Korhonen | B66B 7/02 187/408 |
| 5,950,770 | A * | 9/1999 | Koeppe, Jr. | B66B 7/022 187/406 |
| 6,364,063 | B1 | 4/2002 | Aulanko et al. | |
| 6,742,628 | B2 | 6/2004 | Bauer | |
| 6,868,661 | B2 | 3/2005 | Aulanko et al. | |
| 7,165,656 | B2 * | 1/2007 | Valjus | B66B 7/021 187/406 |
| 7,481,300 | B2 | 1/2009 | Aulanko et al. | |
| 9,469,505 | B2 * | 10/2016 | Piech | B66B 7/022 |
| 2002/0092285 | A1 | 7/2002 | Aulanko et al. | |
| 2002/0185338 | A1 | 12/2002 | Bauer | |
| 2007/0227832 | A1 | 10/2007 | Aulanko et al. | |
| 2011/0296772 | A1 | 12/2011 | Ericson et al. | |

FOREIGN PATENT DOCUMENTS

| | | | | |
|---|---|---|---|---|
| DE | 19945288 | A1 | 4/2001 | |
| DE | 102008016140 | A1 | 11/2009 | |
| EP | 0643007 | A2 | 3/1995 | |
| EP | 1498381 | A1 * | 1/2005 | B66B 7/02 |
| JP | S5161664 | U | 5/1976 | |
| JP | 51102849 | | 9/1976 | |
| JP | H01150687 | A | 6/1989 | |
| JP | 03051284 | A * | 3/1991 | |
| JP | 2005280970 | A | 10/2005 | |
| WO | WO-9829327 | A1 | 7/1998 | |
| WO | WO-2006053935 | A1 | 5/2006 | |
| WO | WO-2010104515 | A1 | 9/2010 | |
| WO | WO 2011077012 | A1 * | 6/2011 | B66B 7/024 |

OTHER PUBLICATIONS

Chinese Office Action dated Sep. 11, 2015 in corresponding application No. 201380006531.5.

International Search Report PCT/ISA/210 for International Application No. PCT/FI2013/050083 dated May 20, 2013.

Written Opinion of the International Searching Authority PCT/ISA/237 for International Application No. PCT/FI2013/050083 dated May 20, 2013.

Finnish Search Report dated Nov. 13, 2012.

* cited by examiner

ARRANGEMENT FOR FIXING THE COMPENSATING WEIGHT GUIDE RAILS OF AN ELEVATOR, AND GUIDE RAIL BRACKET USED IN THE ARRANGEMENT

This application is a continuation of PCT International Application No. PCT/FI2013/050083 which has an International filing date of Jan. 25, 2013, and which claims priority to Finnish patent application number 20125083 filed Jan. 27, 2012, the entire contents of both which are incorporated herein by reference.

FIELD OF THE INVENTION

The object of the invention is an arrangement for fixing the compensating weight guide rails of an elevator and a guide rail bracket for the compensating weight guide rails of an elevator.

BACKGROUND OF THE INVENTION

Although the solution according to the invention mainly relates to an arrangement for fixing the compensating weight guide rails of an elevator, and in the following the object of the inventive arrangement is almost exclusively referred to as the guide rails of compensating weights, the solution according to the invention can just as well be applied also to fixing the guide rails of the counterweight of an elevator, which fixing can be considered as also belonging to the inventive content of the arrangement.

Known in the art are elevator solutions wherein the guide rails of the compensating weights are fixed with their own guide rail brackets e.g. to the wall of the elevator hoistway in a precisely measured location with respect to the elevator hoistway and to the other structures of the elevator. In order for the guide rails to be reliably disposed in the correct location, each guide rail must be separately and precisely plumbed into position. This plumbing, and associated measurements, takes a lot of time and also it is possible that errors occur in the plumbing, which errors can cause damage in the structures of the elevator, noise problems or other problems, or at least extra work for afterwards rectifying the location of the guide rails.

BRIEF DESCRIPTION OF THE INVENTION

The aim of the present invention is to eliminate the aforementioned drawbacks and achieve an inexpensive and easy-to-implement arrangement for fixing the compensating weight guide rails of an elevator. Another aim is to achieve an arrangement that enables easy and quick installation of the compensating weight guide rails, in connection with the installation of which the plumbing of the guide rails into position is not necessarily needed, but instead the location of the compensating weight guide rails is automatically determined on the basis of the location of a guide rail of the elevator car as well as on the basis of the shape, dimensioning and manufacturing tolerances of the guide rail brackets of the compensating weight guide rails. Yet another aim of the invention is to achieve an arrangement wherein the guide rail brackets of the compensating weight guide rails are used also as extension plates for the guide rail extensions of the compensating weight guide rails, in which case separate guide rail extension plates are not needed. The aim of the invention is also to achieve a guide rail bracket for compensating weight guide rails that is inexpensive and versatile and shaped sufficiently precisely in its dimensions, with which guide rail bracket the compensating weight guide rails can be quickly and easily fixed to the structures of the elevator hoistway or to another location suitable for the purpose.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition, it can be stated that at least some of the subordinate claims can, in at least some situations, be deemed to be inventive in their own right.

One advantage, among others, of the solution according to the invention is that by means of it the rapid, easy and reliable fixing of compensating weight guide rails precisely into their own positions is enabled without separate and time-consuming plumbing and/or alignment. Another advantage is that in the installation errors do not occur in the positioning location of the compensating weight guide rails and only the car guide rails need to be plumbed, after which the position of the compensating weight guide rails is automatically determined. Another advantage is cost savings enabled by the installation, owing to the speed and ease of installation.

Preferably the compensating weight guide rails are either tubular or trough-shaped structures, wherein the extensions between guide rail sections comprise aligning support elements inside the tubular or trough-shaped structures, said support elements preferably being extension elements or spring elements that are flexible or are provided with springs. A spring element functioning as an aligning support element and disposed in the extension point of a compensating weight guide rail, inside the guide rail, preferably comprises protrusions or another type of locking parts, which are configured to fix into counterpoints, e.g. into apertures or holes, in the compensating weight guide rails.

BRIEF DESCRIPTION OF THE DRAWINGS

In the following, the invention will be described in more detail by the aid of some examples of its embodiment with reference to the simplified and diagrammatic drawings attached, wherein.

DETAILED DESCRIPTION

The arrangement according to the invention comprises at least an elevator car 1 configured to move reciprocally in an elevator hoistway and at least one or more compensating weights 2*a*, 2*b*, which are for their part connected to support the elevator car 1 by the aid of suspension members 3, such as belts or ropes, and also by the aid of e.g. diverting pulleys mounted on bearings in the top part of the elevator hoistway. In addition, the arrangement according to the invention comprises a hoisting machine 6 provided with at least one traction sheave 5 or corresponding, and at least one or more traction members 7*a*, 7*b*, such as a rope or a belt, that are fully separate from the suspension members 3, which traction members are configured to transmit the rotational movement of the traction sheave 5 into linear movement of the elevator car 1 and of the compensating weights 2*a*, 2*b*. Characteristic to the invention, and common to some of the preferred embodiments of the invention, is that two compensating weights 2*a*, 2*b*, or in some cases more than two compensating weights, are connected by the aid of their own traction member 7*a*, 7*b* provided with essentially spring tensioning or constant-force tensioning to most preferably one and the same hoisting machine 6.

The aforementioned two or more compensating weights 2*a*, 2*b* enable an essentially easy layout in elevator design. At the same time the layout also brings various space benefits. In this case one layout solution can be e.g. the type of layout in which, when viewed from above, at the center of the elevator hoistway is a plane formed by the car guide rails of the elevator and around this plane are four corners for different structural solutions. For example, two corners are used for the compensating weights 2*a*, 2*b* and their guide rails, one corner is used for safety devices, mainly e.g. for an overspeed governor, and one corner is used for other devices, such as for the trailing cables, et cetera.

Figure 1:
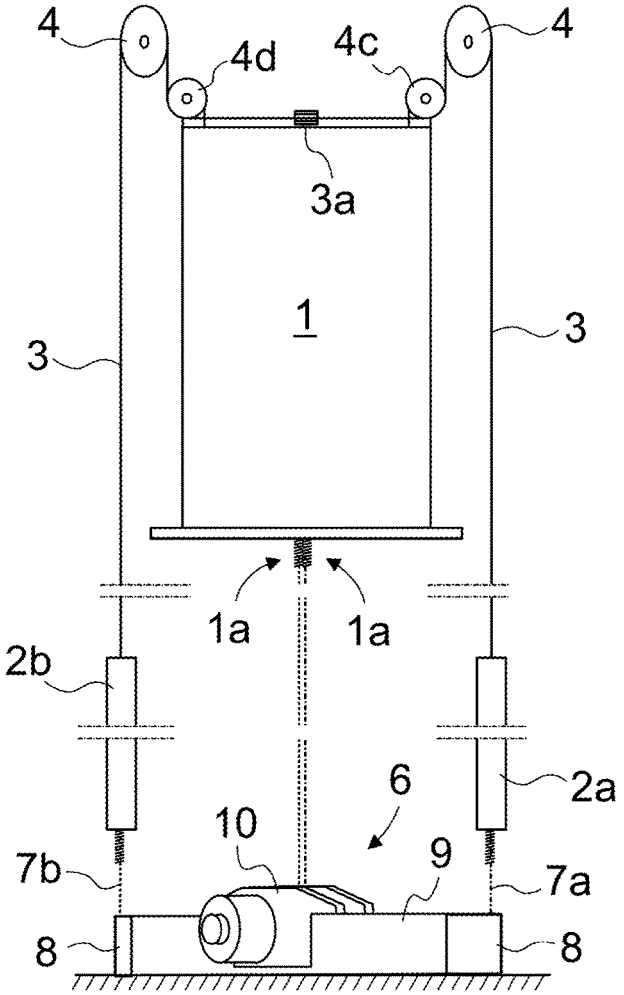
FIG. 1 presents a simplified and diagrammatic side view of one elevator arrangement according to the invention, provided with at least two compensating weights, wherein the hoisting machine of the elevator is disposed in the bottom part of the elevator hoistway, or close to it.
Figure 2:
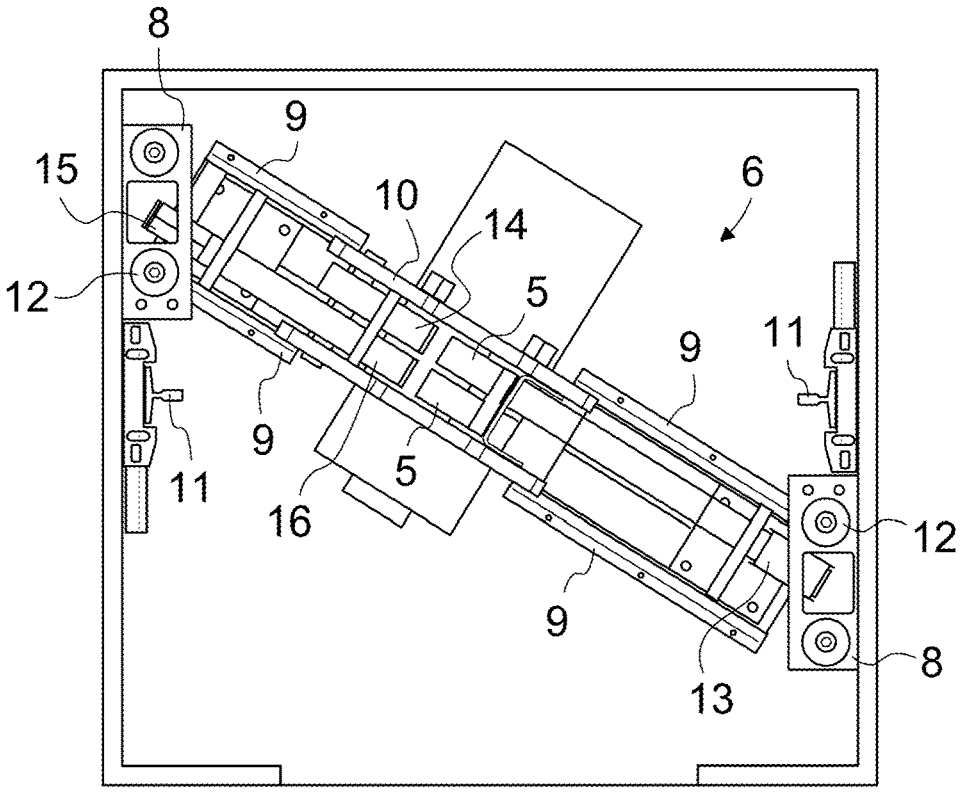
FIG. 2 presents a simplified top view of an elevator arrangement according to FIG. 1, in the bottom part of the elevator hoistway.

FIG. 1 presents a simplified and diagrammatic side view of one elevator arrangement according to the invention, said arrangement being provided with at least two compensating weights, and FIG. 2 presents a simplified top view of an elevator arrangement according to FIG. 1, in the bottom part of the elevator hoistway. The elevator arrangement according to FIGS. 1 and 2 comprises two compensating weights 2*a* and 2*b*, both of which are connected to the elevator car 1 by the aid of common suspension members 3. There can be one suspension member 3 or a number of them side by side. The suspension member 3 is fixed at its first end to a first compensating weight 2*a* functioning as a counterweight, and passes over a first diverting pulley 4 in the top part of the elevator hoistway or in the machine room and onwards above the elevator car 1 under the diverting pulleys 4*c* and 4*d* disposed on the elevator car 1, and ascends upwards again and passes over a second diverting pulley 4 in the top part of the elevator hoistway or in the machine room and descends downwards to a second compensating weight 2*b* functioning as a counterweight, to which compensating weight the suspension member 3 is fixed at its second end. In addition, a rope clamp 3*a* or corresponding locking means is fixed to the top part of the elevator car 1, with which locking means each suspension member 3 is locked into position on the top part of the elevator car 1, e.g. during servicing work on the elevator.

A hoisting machine 6 provided with a one-piece or two-piece traction sheave 5 is configured to move the elevator car 1, which hoisting machine is preferably e.g. a machine station of modular structure and is disposed in the bottom part of the elevator hoistway, e.g. on the base of the elevator hoistway or right in the proximity of the base. In this case installation of the hoisting machine 6 is easy, and long electric cables from the bottom part of the building to the hoisting machine and to the cubicles are not needed. Additionally, at least one humidity sensor, which is arranged to issue an alarm and if necessary to stop the elevator if excessive water comes onto the base of the hoistway, is disposed on the base of the hoistway. In this way the elevator machine and the electrical components of the elevator can be protected from excessive humidity.

For each compensating weight separately its own traction member 7*a*, 7*b* is disposed between the bottom part of the compensating weights 2*a*, 2*b* and the bottom part of the elevator car 1, which traction member receives its movement transmission force from the traction sheave 5 of the hoisting machine 6, said traction sheave rotating on the vertical plane. The first traction member 7*a* is fixed at its first end to a first compensating weight 2*a*, is configured to leave the compensating weight 2*a* and go downwards and is led to pass around the bottom of a first diverting pulley 13 on a first side of the traction sheave 5, after which the traction member 7*a* is led past the traction sheave 5 of the hoisting machine 6 fitted below the elevator car 1 below the traction sheave 5 from the first side to the second side of the traction sheave and onwards below a second diverting pulley 14 on the second side of the traction sheave 5 and disposed in connection with the hoisting machine 6, around the diverting pulley and back towards the traction sheave 5 of the hoisting machine 6, after passing around the bottom of which the traction member 7*a* is led upwards from the first side of the traction sheave 5 to a fixing point in connection with the elevator car 1, to which fixing point the second end of the traction member 7*a* is fixed.

Correspondingly the second traction member 7*b* is configured to travel from the second compensating weight 2*b* via the traction sheave 5 to the elevator car 1 in such a way that the second traction member 7*b* is fixed at its first end to the second compensating weight 2*b*, is configured to leave the compensating weight 2*b* and go downwards and is led to pass around the bottom of at least one third diverting pulley 15 on the second side of the traction sheave 5, after which the traction member 7*b* is led over a fourth diverting pulley 16 on the second side of the traction sheave 5 to the traction sheave 5 of the hoisting machine 6 disposed below the elevator car 1 from the second side of the traction sheave 5 and is configured to pass around the bottom of the traction sheave 5 and to ascend after this from the first side of the traction sheave 5 to the elevator car 1, to the fixing point in connection with which elevator car the second end of the traction member 7*b* is fixed.

The contact surface of the traction sheave 5 is so wide that both the traction members 7*a*, 7*b* fit side-by-side onto the contact surface of the traction sheave 5 without interfering with each other. In this way one and the same hoisting machine 6 and also one and the same traction sheave 5 give to both the traction members 7*a*, 7*b* a force producing linear movement of the elevator car 1 and of the compensating weights 2*a*, 2*b*. A second alternative is a structural solution, in which the same traction shaft has two parallel traction sheaves 5.

From FIG. 2 it is seen that the hoisting machine 6 functioning as a modular machine station, with its support structures 9, 10, and with its diverting pulleys 13-15 and with its traction sheave 5, is at some certain angle with respect to the guide rail line of the guide rails 11 of the elevator car 1. This angle can vary, depending on the respective elevator layout solution. The hoisting machine 6, with associated support structures 9, 10, functioning as a machine station is fixed at its ends to brackets 8, which are further fixed e.g. to the wall of the elevator hoistway. The guide rails 11 of the elevator car 1 are fixed at their bottom ends to the same brackets 8, which are made to be dimensionally precise in such a way that the guide rails 11 can easily be positioned precisely in their correct locations.

Figure 3:
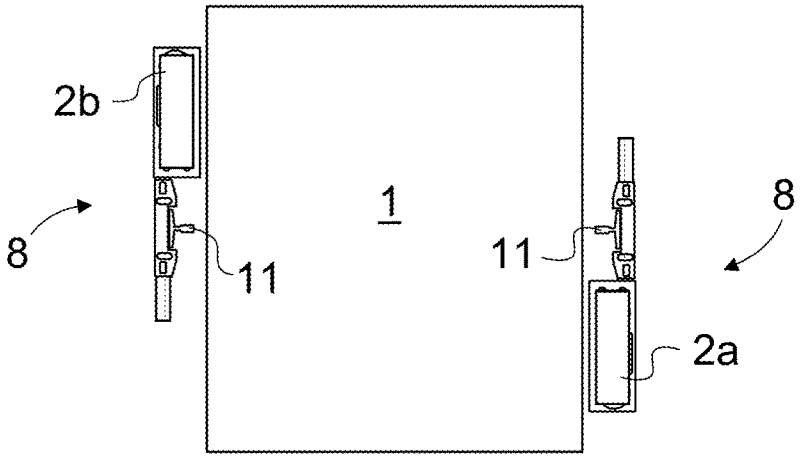
FIG. 3 presents a simplified and diagrammatic top view of one elevator arrangement according to FIG. 1, wherein the compensating weights are disposed on different sides of the guide rail line of the elevator car to each other and on different sides of the elevator car.

FIG. 3 presents a top view of one arrangement according to the invention for disposing the compensating weights 2*a*, 2*b* in the elevator hoistway. In FIG. 3 the compensating weights 2*a*, 2*b* are disposed on opposite sides of the elevator car 1 and on different sides of the guide rail line of the elevator car 1 to each other, in which case the suspension of the elevator car 1 and of the compensating weights 2*a*, 2*b* is extremely symmetrical and does not produce any additional stresses e.g. on the guide rails 11 of the elevator car. This is an extremely advantageous layout option if it is only possible.

Figure 4:
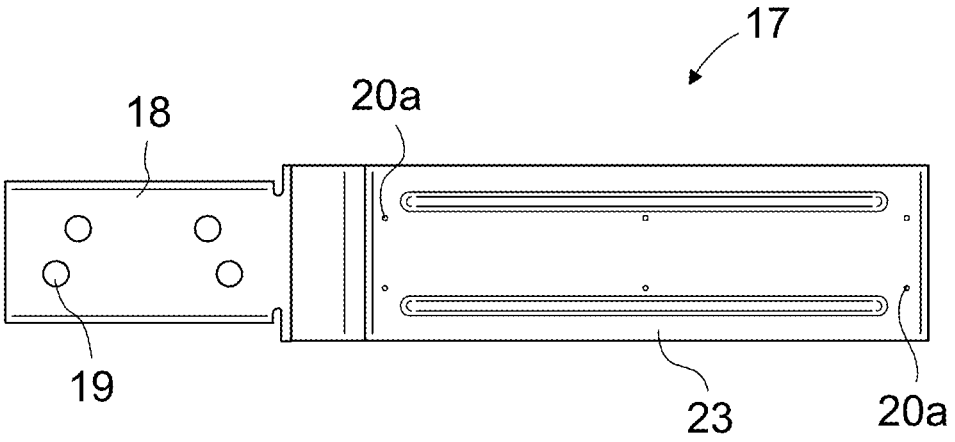
FIG. 4 presents a side view of one guide rail bracket of a compensating weight guide rail to be used in an arrangement according to the invention.
Figure 5:
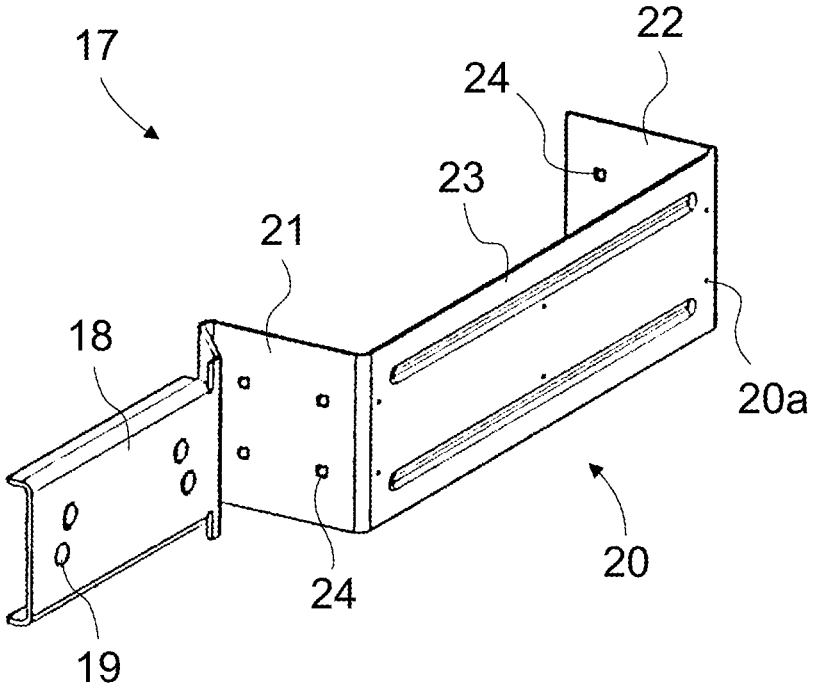
FIG. 5 presents an oblique view from the top and side of a guide rail bracket of a compensating weight guide rail according to FIG. 4.
Figure 6:
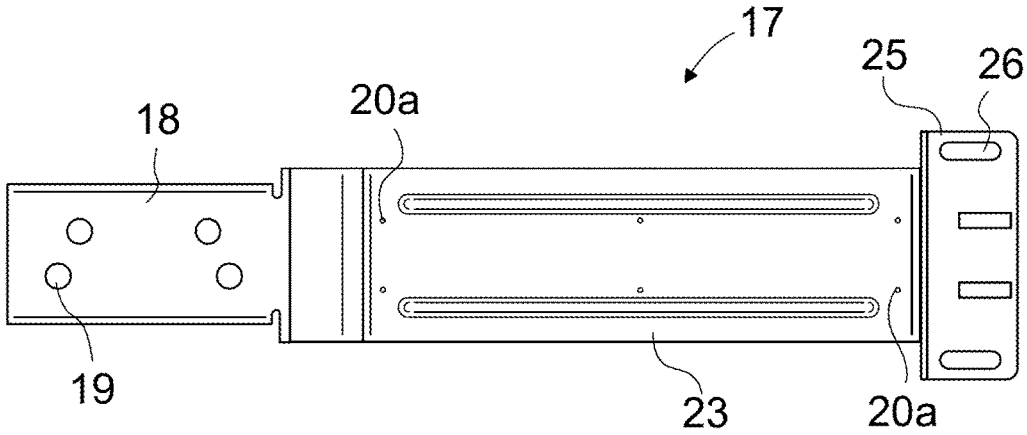
FIG. 6 presents a side view of a guide rail bracket of a compensating weight guide rail according to FIG. 4, provided with a wall bracket according to the invention.
Figure 7:
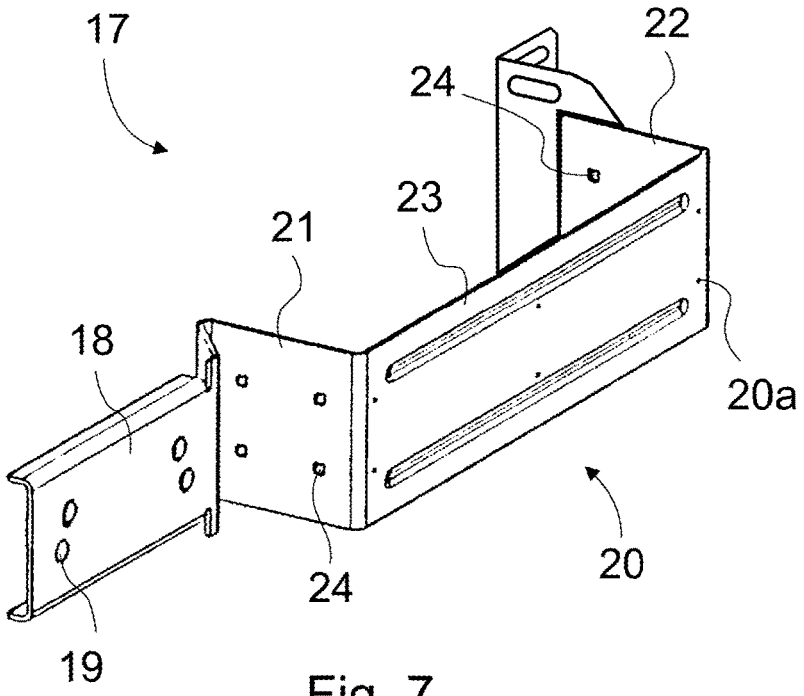
FIG. 7 presents an oblique view from the top and side of a guide rail bracket of a compensating weight guide rail according to FIG. 4, provided with a wall bracket according to the invention.

FIGS. 4-7 present a guide rail bracket 17 of a compensating weight guide rail to be used in the arrangement according to the invention. FIGS. 4 and 5 present just the guide rail bracket 17 of a compensating weight guide rail and FIGS. 6 and 7 present the same guide rail bracket 17 provided with a wall bracket 25.

The guide rail bracket 17 of the compensating weight guide rail is a bracket fabricated e.g. from one metal plate by bending and otherwise machining, the first end of which bracket comprises an essentially planar fixing part 18 with fixing holes 19 for the guide rails 11 of the elevator car 1. Correspondingly, the second end of the guide rail bracket 17 is configured to form a mounting base 20 for the guide rails of the compensating weight. The mounting base 20 comprises a first essentially planar fixing part 21 and a second essentially planar fixing part 22 for the guide rails of the compensating weight, which fixing parts 21, 22 are essentially in the same direction as each other. The fixing parts 21, 22 are rigidly connected to each other with the back part 23 of the guide rail bracket 17, which back part is essentially orthogonal to the plane of the fixing parts 21, 22. The fixing parts 21, 22 have fixing holes 24 for fixing the guide rails of the compensating weight to the guide rail bracket 17 and, in addition, the fixing part 22 has, if necessary extra fixing holes for fixing a separate wall bracket 25 to the second end of the guide rail bracket 17. A guide rail bracket 17 is fixed by means of a wall bracket 25 e.g. to the wall of the elevator hoistway. The wall bracket 25 correspondingly has elongated fixing holes 26, by means of which the wall bracket 25 can be fixed to a suitable location in a manner allowing adjustment, both to the guide rail bracket 17 and to the wall of the elevator hoistway or corresponding fixing location. In addition, the mounting base 20 of the guide rail bracket 17 has fixing holes 20*a* for the cover plate 29 presented in FIGS. 8 and 14.

Figure 8:
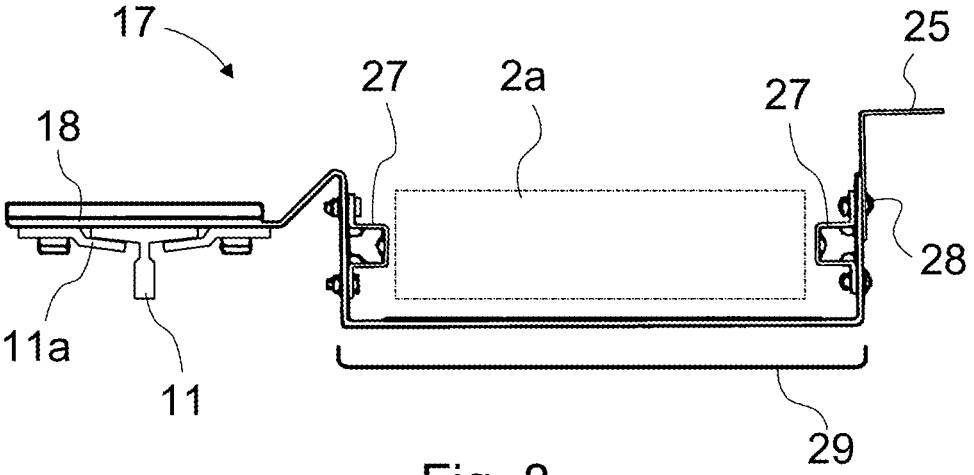
FIG. 8 presents a top view of a compensating weight, the detached cover plate of the compensating weight, said cover plate to be disposed in front of the path of travel of the compensating weight, and also a guide rail bracket of a compensating weight guide rail according to FIG. 4 provided with compensating weight guide rails according to the invention and with a wall bracket.
Figure 9:
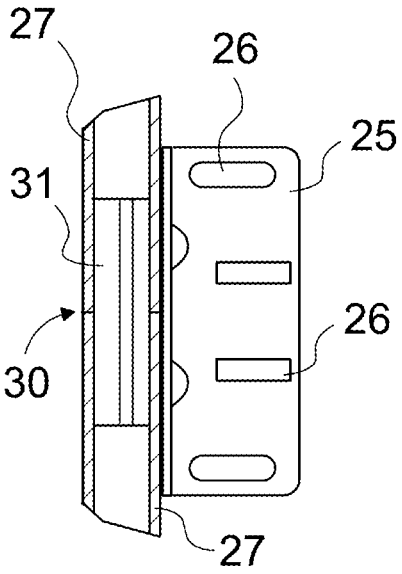
FIG. 9 presents a simplified and sectioned side view of one second end of a guide rail bracket, with a wall bracket, according to the invention at the extension point of the compensating weight guide rails.
Figure 10:
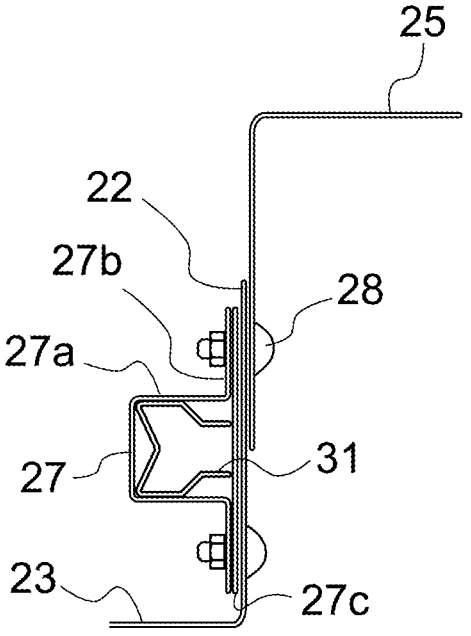
FIG. 10 presents a simplified and magnified top view of a second end of a guide rail bracket of a compensating weight guide rail, with its wall bracket, and provided with a compensating weight guide rail.
Figure 11:
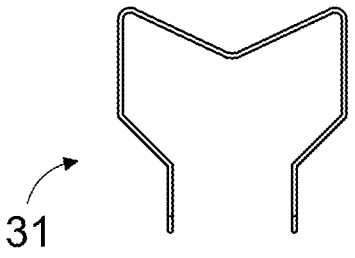
FIG. 11 presents a top view of one extension piece for compensating weight guide rails, said extension piece to be used in an arrangement according to the invention.
Figure 12:
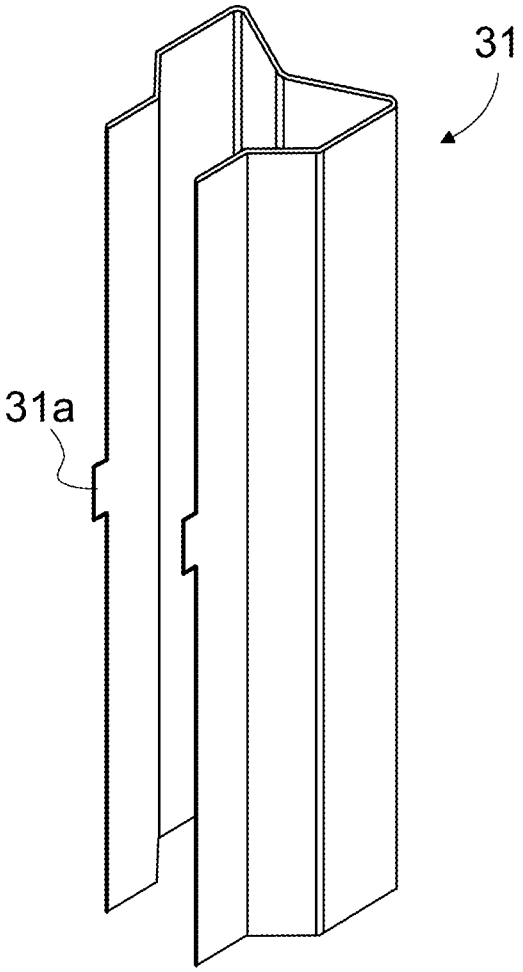
FIG. 12 presents an oblique view from the top and side of an extension piece, according to FIG. 11, for compensating weight guide rails.

FIGS. 8-10 present a guide rail bracket 17 of a compensating weight guide rail to be used in the arrangement according to the invention, said guide rail bracket being provided with compensating weight guide rails 27 and with a compensating weight 2*a*. FIG. 8 presents a top view of a compensating weight 2*a*, which is drawn with a dot-and-dash line, a detached cover plate 29 to be disposed in front of the path of travel of the compensating weight 2*a* and to be fixed to the guide rail bracket 17, and a guide rail bracket 17 of a compensating weight guide rail according to the invention provided with the guide rails 11 of the elevator car 1. Correspondingly, FIG. 9 presents a side view and FIG. 10 a simplified and partially sectioned top view of one second end of a guide rail bracket 17 according to the invention, with wall bracket 25, at the extension point 30 of the compensating weight guide rails 27. The compensating weight guide rail 27, which comprises e.g. a guide rail part 27*a* that is at least in its cross-sectional shape essentially rectangular and flange parts 27*b* on both sides of the guide rail part 27*a*, said flange parts being essentially the length of the compensating weight guide rail 27, and a back plate 27*c*, essentially the length of the compensating weight guide rail 27, closing the guide rail part into a box section, is fixed to the second fixing part 22 of the guide rail bracket 17 with fixing means 28, such as with screws and nuts. In addition, the wall bracket 25 is fixed to the fixing part 22, to a suitable point, e.g. with the same fixing means 28 as the compensating weight guide rail 27. Inside the compensating weight guide rail 27 is seen a spring element 31, disposed in the extension point of the guide rails and functioning as an aligning support element that replaces an extension plate, said spring element being presented in more detail in FIGS. 11-12 and having on its open side edge protrusions 31*a*, which settle in the extension point of the compensating weight guide rails 27 into small apertures in the compensating weight guide rails 27.

Figure 13:
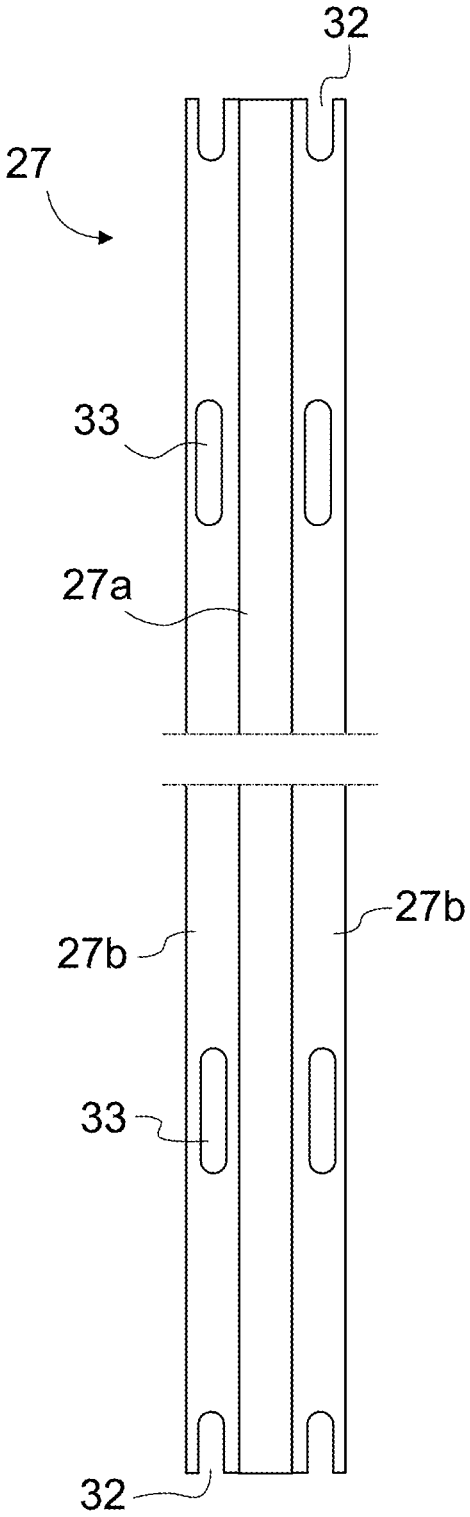
FIG. 13 presents a truncated front view of one compensating weight guide rail to be used in an arrangement according to the invention.

FIG. 13 presents a truncated front view of one compensating weight guide rail 27 to be used in an arrangement according to the invention. In FIG. 13 only a part of both ends of a compensating weight guide rail 27 are seen, in the flange part 27*b* of both of which are elongated fixing holes 32 open from the end. In addition, there are elongated fixing holes 33 at regular intervals in the flange parts of a compensating weight guide rail 27, via which fixing holes the compensating weight guide rail 27 can be fixed to the guide rail bracket 17.

As stated earlier, the guide rail brackets 17 of the compensating weight guide rails 27 are used also as extension plates for the guide rail extensions of the compensating weight guide rails 27, in which case separate guide rail extension plates are not needed. If for some reason a guide rail bracket 17 of a compensating weight guide rail 27 cannot be disposed at the extension point of standard-length compensating weight guide rails 27 onto a guide rail 11 of the elevator car 1, the aforementioned compensating weight guide rails 27 are cut shorter in the installation phase at the center point of the next, as seen from the end, elongated fixing hole 33 so that the guide rail bracket 17 of the compensating weight guide rail 27 can be attached also to the guide rail 11 of the elevator car 1 at the extension point 30, which is now situated lower owing to the truncation. Such reasons are e.g. an extension of the car guide rail to be made at the point in question using a separate extension plate or the fixing of some device to the car guide rail or the fixing of the car guide rail with a separate bracket to hoistway structures. It is even possible within the scope of the basic inventive concept to make the fixing of a compensating weight guide rail to the car guide rail, or an extension of the compensating weight guide rail and the fixing of the extension to the car guide rail, without fixing the guide rail bracket to the wall of the hoistway or to another hoistway structure. Often, however, it is more advantageous to fix the guide rail bracket to the wall of the hoistway or to another hoistway structure in addition to the car guide rail.

Figure 14:
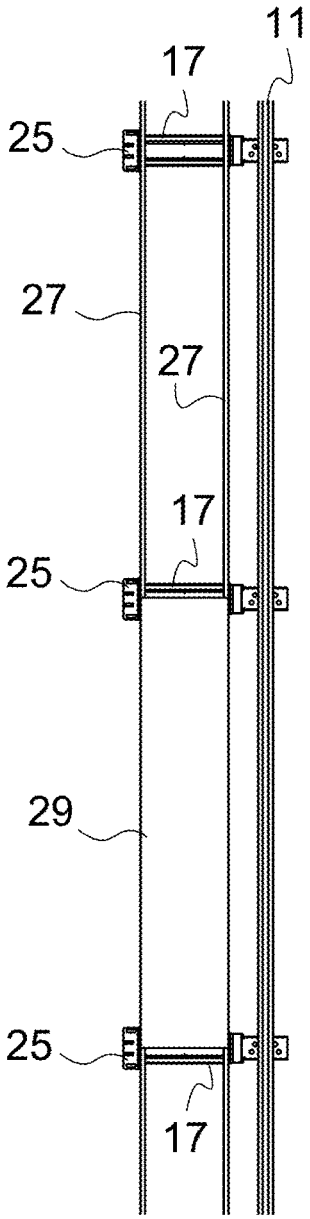
FIG. 14 presents three guide rail clamps, in position, of a compensating weight guide rail and a part of both the compensating weight guide rails and of the guide rail of the car of the elevator.

FIG. 14 presents three guide rail brackets 17 of a compensating weight guide rail 27, as viewed from the direction of the elevator car 1, in their position and a part of both the compensating weight guide rails 27 and of the guide rail 11 of the car of the elevator. The compensating weight is not presented in FIG. 14, but a cover plate 29 is fixed in front of the guide rails 27 of the compensating weight, between the guide rails 27 and the elevator car 1, which cover plate is fixed e.g. at both ends to the fixing holes 20*a* of the mounting base 20 of the guide rail bracket 17. The cover plate 29 functions as a protective plate e.g. when an elevator fitter or service person is in the elevator hoistway and drives the elevator. Likewise, the cover plate 29 functions as a noise-damping restraint when installed at a point in which the elevator car 1 and the compensating weights 2*a*, 2*b* meet in the elevator hoistway.

In the arrangement according to the invention the shape and dimensioning of the guide rail brackets 17 of the compensating weight guide rails 27, as well as the manufacturing tolerances and the positions and dimensioning of the fixing holes 24 in the guide rail brackets 17 of the compensating weight guide rails as well as of the fixing holes 32, 33 of the compensating weight guide rails 27, are configured to be such that the position of the compensating weight guide rails 27 is ready in the guide rail brackets 17 of the compensating weight guide rails 27 to a sufficient degree of accuracy and by fixing the guide rail brackets 17 to the guide rails 11 of the elevator car 1 on a fixing point for the guide rail 11, the compensating weight guide rails 27 can be fixed sufficiently precisely into their position without separate plumbing, because it is sufficient that only the guide rails 11 of the elevator car 1 are plumbed. In this case the location of the compensating weight guide rails 27 with respect to the guide rail 11 of the elevator car 1 and the distance between the compensating weight guide rails 27 are determined by the shape, dimensioning, fixing holes 24, 32, 33 and manufacturing tolerances of the guide rail bracket 17, and the whole fixing arrangement can be conceived as seeking its guidance according to the guide rail line of the guide rails 11 of the elevator car 1. The guide rail bracket 17 comprises means for fixing the guide rail bracket 17 to the guide rail 11 of the elevator car 1 and for fixing the compensating weight guide rails 27 to the guide rail bracket 17 in such a way that when fixing the guide rail bracket 17 to the guide rail 11 of the elevator car 1 the precise location of the compensating weight guide rails 27 are simultaneously determined.

In the arrangement according to the invention the traction member 7*a*, 7*b* can be either a plurality of parallel hoisting ropes, a chain or a belt, e.g. a toothed belt. What all the aforementioned solutions have in common is that the traction members 7*a*, 7*b* are fixed at one of their ends, e.g. their end on the elevator car 1 side, with a fixing means 1*a* providing a spring force or a constant tensioning force in such a way that a traction member 7*a*, 7*b* always remains sufficiently taut on the rim of the traction sheave 5 and that when the suspension members 3 of the elevator car 1 stretch and loosen the fixing means 1*a* remove the elongation produced via the traction members 7*a*, 7*b* and the suspension of the suspension members 3 compensates the elongation by keeping the elevator car 1 always on an even bearing.

In the elevator arrangement according to the invention the supporting of the elevator car 1 is separated from the moving means of the elevator car and smart materials, such as toothed belts, in which traction is not based on friction but instead on shape-locking, preferably suited to the purpose are used as the moving means, i.e. as the traction members 7*a*, 7*b*. Since the traction is not based on friction and elongations of the suspension members 3 can easily be compensated, one or more compensating weights 2*a*, 2*b* can be used instead of counterweights, which compensating weights are disposed in the elevator hoistway space-efficiently in relation to the cross-section of the elevator hoistway and their mass is optimized according to the use of the elevator such that the elevator arrangement is made to function in the best possible way in relation to energy-efficiency in exactly the use for which it has been delivered. The aforementioned space-efficiency can be further improved with traction sheaves and diverting pulleys that are small in diameter and that can be disposed in a small space.

Also common to all the solutions presented is that the point of location of the diverting pulleys 4*a*-4*d* disposed on the elevator car 1 is configured such that the elevator car 1 can rise past the diverting pulleys 4 in the top end of the hoistway right to the top end of the hoistway. In this way the most space-efficient layout solution possible is achieved in the top end of the hoistway.

It should also be noted that the different solutions and features presented above can be inventive features together with one or more other features of the invention.

It is obvious to the person skilled in the art that the invention is not limited solely to the examples described above, but that it may be varied within the scope of the claims presented below. Thus, for example, the suspension solutions can be different to what is presented above.

It is further obvious to the person skilled in the art that the location of the hoisting machine can also be elsewhere than what is presented above in the drawings. The hoisting machine can be on the base of the elevator hoistway, or close to the base, but also on some side of the elevator hoistway and also in the top part of the elevator hoistway.

It is also obvious to the person skilled in the art that the number of compensating weights can also be greater than one or two. There can be e.g. three, four, six, eight, ten or even more compensating weights disposed in a different manner.

It is also obvious to the person skilled in the art that the shape and the structure of the guide rail bracket used may also differ from what is presented above.

The invention claimed is:

1. An elevator arrangement comprising:

an elevator car configured to move reciprocally along a guide rail;

at least one compensating weight configured to support the elevator car by at least one suspension rope and at least one diverting pulley, the at least one compensating weight being guided by compensating weight guide rails; and a hoisting machine including a traction sheave and at least one traction rope configured to transfer rotational movement of the traction sheave into movement of the elevator car and movement of the at least one compensating weight, wherein the compensating weight guide rails are fixed in place with guide rail brackets and are configured to extend vertically, the guide rail brackets including fixing parts for the compensating weight guide rails and for the guide rail, and the compensating weight guide rails include a spring element in an extension point of the compensating weight guide rails, the spring element configured to function as an aligning support element.

2. The elevator arrangement according to claim 1, wherein the fixing parts include fixing holes; and a shape and dimensions of the guide rail brackets and manufacturing tolerances, positions, and dimensions of the fixing holes are configured such that the guide rail brackets determine a positioning location of the compensating weight guide rails, when the guide rail brackets are fixed to the guide rail.

3. The elevator arrangement according to claim 2, wherein the positioning location of the compensating weight guide rails is set without a separate plumbing or alignment of the compensating weight guide rails.

4. The elevator arrangement according to claim 1, wherein a location of the compensating weight guide rails with respect to the guide rail and a distance between the compensating weight guide rails are configured to be determined by a shape, dimensions, fixing holes and manufacturing tolerances of the guide rail brackets, and wherein the fixing holes are configured in accordance with a guide rail line of the guide rail.

5. The elevator arrangement according claim 1, further comprising:

at least one wall bracket configured to fix a first end of at least one of the guide rail brackets to a fixing point in a hoistway of the elevator car, a second end of the at least one of the guide rail brackets being fixed to the guide rail, the compensating weight guide rails being fixed in the hoistway via the guide rail brackets such that the at least one compensating weight is configured to move in the hoistway.

6. The elevator arrangement according claim 1, further comprising:

a cover plate fixed to at least two guide rail brackets, the guide rail brackets being consecutive in a vertical direction.

7. The elevator arrangement according claim 1, wherein the compensating weight guide rails include a lower compensating weight guide rail and an upper compensating weight guide rail arranged consecutively in a vertical direction from a bottom of a hoistway, and wherein a top end of the lower compensating weight guide rail and a bottom end of the upper compensating weight guide rail are configured to be fixed on the same guide rail bracket in an extension point of the compensating weight guide rails.

8. The elevator arrangement according claim 1, wherein the compensating weight guide rails include elongated fixing holes at fixed intervals, the compensating weight guide rails being configured to be cut through the center point of the elongated fixing holes for finding a correct point for an extension of the compensating weight guide rails with the guide rail brackets.

9. A guide rail bracket for fixing the compensating weight guide rails of an elevator, the guide rail bracket comprising:

a first fixing-parts for fixing two separate compensating weight guide rails in place, each of the two separate compensating weight guide rails including a spring element in an extension point of respective ones of the two separate compensating weight guide rails, the spring element configured to function as an aligning support element; and a second fixing-parts for fixing a guide rail of the elevator.

10. The guide rail bracket according to claim 9, wherein a final positioning location of both the guide rail and the compensating weight guide rails are ready in the same guide rail bracket.

11. The guide rail bracket according to claim 9, wherein both the first fixing-parts and second fixing-parts include a plurality of fixing holes, and wherein a shape and dimensions of the guide rail bracket and manufacturing tolerances, positions, and dimensions of the plurality of fixing holes are configured such that a final positioning location of the compensating weight guide rails is ready in the guide rail bracket, the final positioning location being with respect to the guide rail, and the guide rail bracket being fixed to the guide rail.

12. The guide rail bracket according to claim 9, wherein a first end and a second end of the guide rail bracket include fixing holes for fixing the guide rail bracket to the guide rail and to a position in an elevator hoistway.

13. A guide rail bracket of an elevator comprising:

a first end configured to fix a guide rail of the elevator in place;

a second end configured to fix the guide rail bracket to a position in a hoistway of the elevator; and a portion between the first end and second end, the portion being configured to fix at least two separate compensating weight guide rails in place such that the at least two separate compensating weight guide rails each extend vertically in the hoistway, the at least two separate compensating weight guide rails each including a spring element in an extension point of respective ones of the two separate compensating weight guide rails, the spring element configured to function as an aligning support element.

14. The guide rail bracket according to claim 13, wherein the guide rail bracket includes a plurality of fixing holes for fixing the compensating weight guide rails and the guide rail bracket.

15. The guide rail bracket according to claim 14, wherein a shape and dimensions of the guide rail bracket and manufacturing tolerances, positions, and dimensions of the plurality of fixing holes are configured such that a final positioning location of the at least two separate compensating weight guide rails is ready in the guide rail bracket, the final positioning location being with respect to the guide rail, and the guide rail bracket being fixed to the guide rail.

16. The guide rail bracket according claim 13, wherein the spring element is configured to function as an aligning support element for an extension of the compensating weight guide rails and the guide rail bracket.

* * * * *